US005309836A

United States Patent [19]

Takeuchi

[11] Patent Number: 5,309,836

[45] Date of Patent: May 10, 1994

[54] CLEANING DEVICE FOR OFFSET PRINTING MACHINE

[75] Inventor: Hideo Takeuchi, Chiba, Japan

[73] Assignee: Comtec Co., Ltd., Japan

[21] Appl. No.: 984,362

[22] Filed: Dec. 2, 1992

[30] Foreign Application Priority Data

Dec. 3, 1991 [JP] Japan ..... 3-318836

[51] Int. Cl.[5] ..... B41F 35/00

[52] U.S. Cl. ..... 101/423; 101/425

[58] Field of Search ..... 101/423, 424, 425, 365

[56] References Cited

U.S. PATENT DOCUMENTS

| | | | |
|---|---|---|---|
| 4,173,185 | 11/1979 | Voegelin | 101/365 |
| 4,463,675 | 8/1984 | Ottenhues | 101/169 |
| 4,639,776 | 1/1987 | Foerster et al. | 101/365 |
| 4,703,691 | 11/1987 | Takeuchi et al. | 101/365 |
| 4,893,562 | 1/1990 | Robertson | 101/425 |
| 4,922,820 | 5/1990 | Grossman et al. | 101/425 |

FOREIGN PATENT DOCUMENTS 0287822 10/1988 European Pat. Off. ..... B41F 35/02

*Primary Examiner*—Edgar S. Burr
*Assistant Examiner*—Anthony H. Nguyen
*Attorney, Agent, or Firm*—Ladas & Parry

[57] ABSTRACT

A cleaning device is disclosed for an offset printing machine for quickly removing stains on a printed matter. A number of scrapers (7) are arranged in an axial direction of the surface of a printing drum (1) of the offset printing machine. The scrapers (7) are held by rods of air cylinders (8) which cause the scrapers to contact or be separated away from the surface of the drum (1). Solenoid valves are arranged corresponding to respective cylinders. The solenoid valves are controlled by a control unit (16). The position of hickey on the surface of the drum is designated from an information of a hickey position on the printed matter generated corresponding to the stain on the surface of the drum. When the associated solenoid valves are actuated, then the scrapers are brought into contact with the hickey position on the drum surface to scrape the hickey.

12 Claims, 4 Drawing Sheets

CLEANING DEVICE FOR OFFSET PRINTING MACHINE

BACKGROUND OF THE INVENTION

The present invention relates to a cleaning device for removing dregs on surfaces of printing drums in an offset printing machine.

In the case where a printing operation is effected by using the offset printing machine, there would be a fear that ink dregs, lees, paper powders and the like would be generated on a surface of a printing drum to form hickeys on a printed matter.

Conventionally, when such hickey is formed, the operator of the printing machine comes to the position where the hickey such as ink dregs is produced on the printing drum. A jig is applied to the surface of the printing drum to remove the dregs therefrom. The jig is made of a rubber piece provided at a free end of a rod, for example.

However, since such a cleaning operation must be effected for the operator to access the place where the printing drum is rotated at a high speed, it is very dangerous. Also, since the place where the hickey is produced must be found, it is time consuming to remove the hickey.

SUMMARY OF THE INVENTION

An object of the present invention is to provide a cleaning device in which a stain removal action may be performed in an automatic manner.

According to the present invention, there is provided a cleaning device for an offset printing machine, comprising: a plurality of scrapers arranged along a surface of a printing drum of the printing machine for scraping hickeys on a surface of the printing drum; a plurality of air cylinders for bringing the respective scrapers into contact with and away from the surface of the printing drum; a plurality of solenoid valves disposed for the associated air cylinders; and a control unit for designating a position of a hickey in accordance with a position of dregs on a printing matter generated corresponding to dregs on the surface of the drum, and operating the corresponding solenoid valve to move the scraper onto the surface of the printing drum in which the dregs are generated.

The solenoid valves may include first solenoid valves for the scrapers, and second solenoid valves for respective printing units.

The control unit may include a timer circuit for setting an opening period of the solenoid valves, and a memory circuit for storing the position of hickey.

The operational board is used for inputting various parameters for removing the hickeys.

When the stains (i.e., hickey) in the printed matter would be admitted in the delivery section by the operator of the offset printing machine, the position of the dregs on the surface of the printing drum is specified while referring to the printed matter.

Then, the operator operates the solenoid valves corresponding to the dregs on the surface of the printing drums, in accordance with the button operation of the controls section. As a result, the air cylinders corresponding to the solenoid valves, and the scrapers are brought into contact with the drum surface. The scrapers may scrape the dregs away from the printing drum surfaces. After that, the solenoids are operated by the timer circuit so that the scrapers will be separated away from the surface of the printing drum. Thus, the stains or dregs are removed in an automatic manner to thereby remove the hickey of the printed matter.

DESCRIPTION OF THE PREFERRED EMBODIMENTS

The present invention will now be described with reference to the accompanying drawings FIGS. 1 to 4 show a cleaning apparatus for an offset printing machine.

Figure 4:
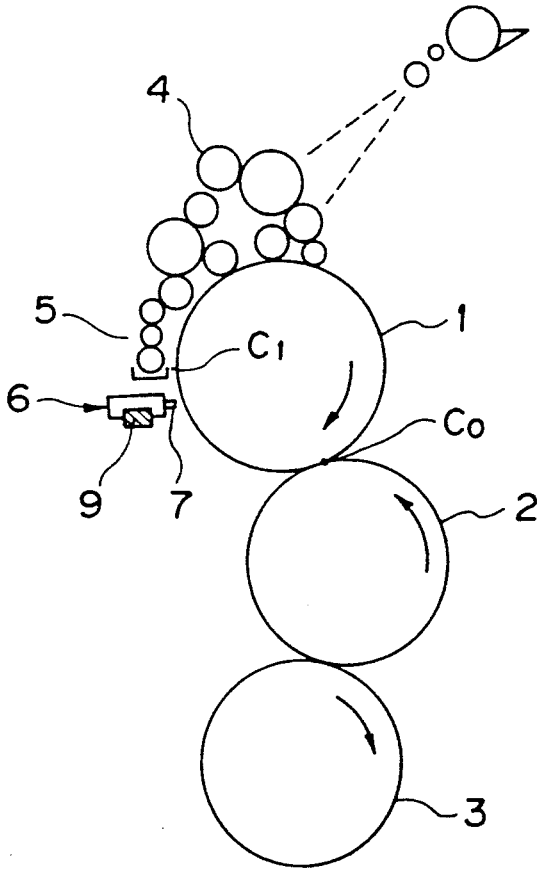
FIG. 4 is a side elevation view showing a color unit of the offset printing machine provided with the cleaning device.

First of all, as shown in FIG. 4, a printing unit for each color of the offset printing machine includes a printing drum plate (cylinder) 1, a blanket drum 2 and a pressure drum 3. Also, an ink device 4 and a water applicator 5 are provided around the printing drum 1.

Figure 1:
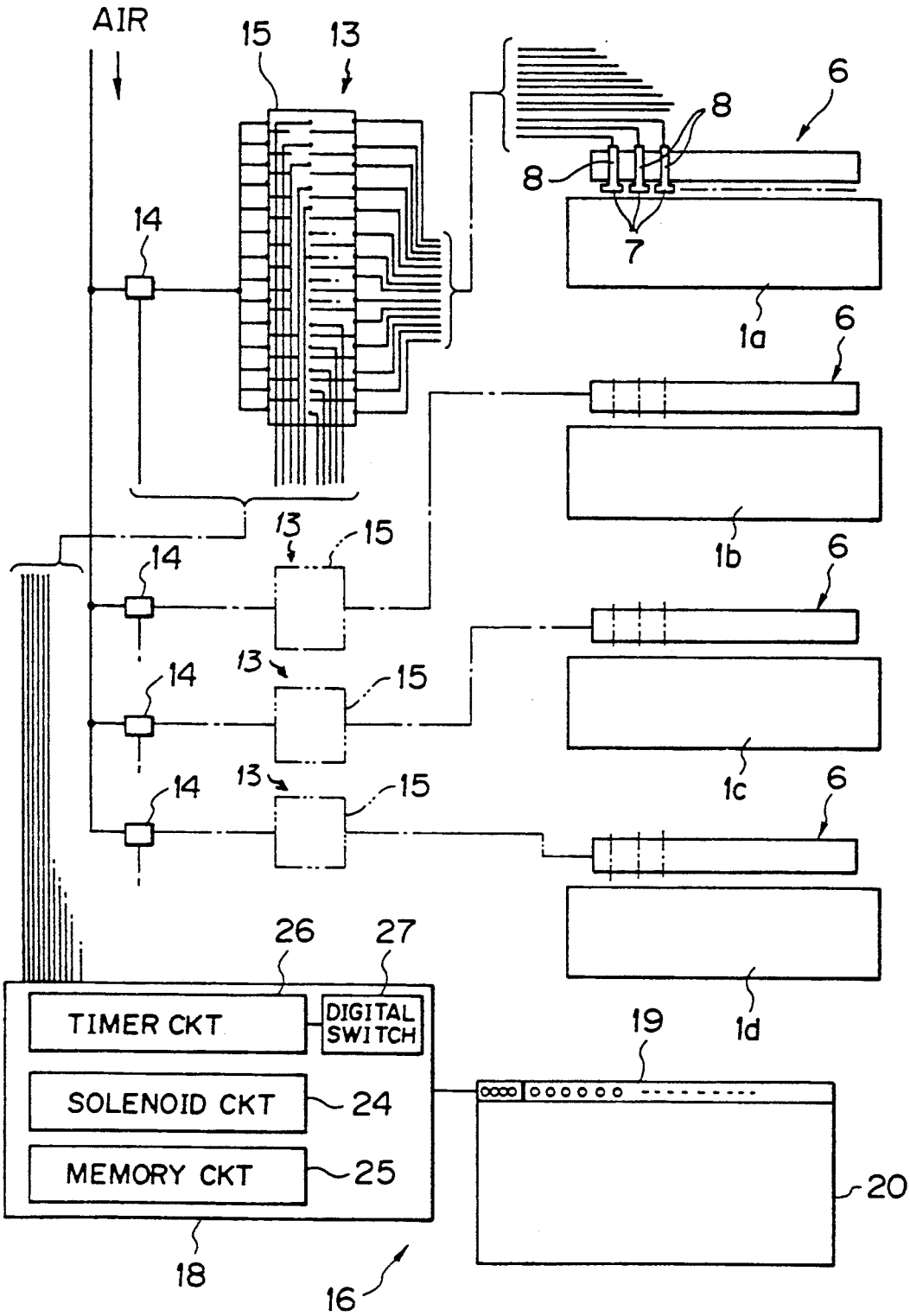
FIG. 1 is a block diagram showing a structure of a dreg removing or cleaning device of an offset printing machine according to the present invention.
Figure 2:
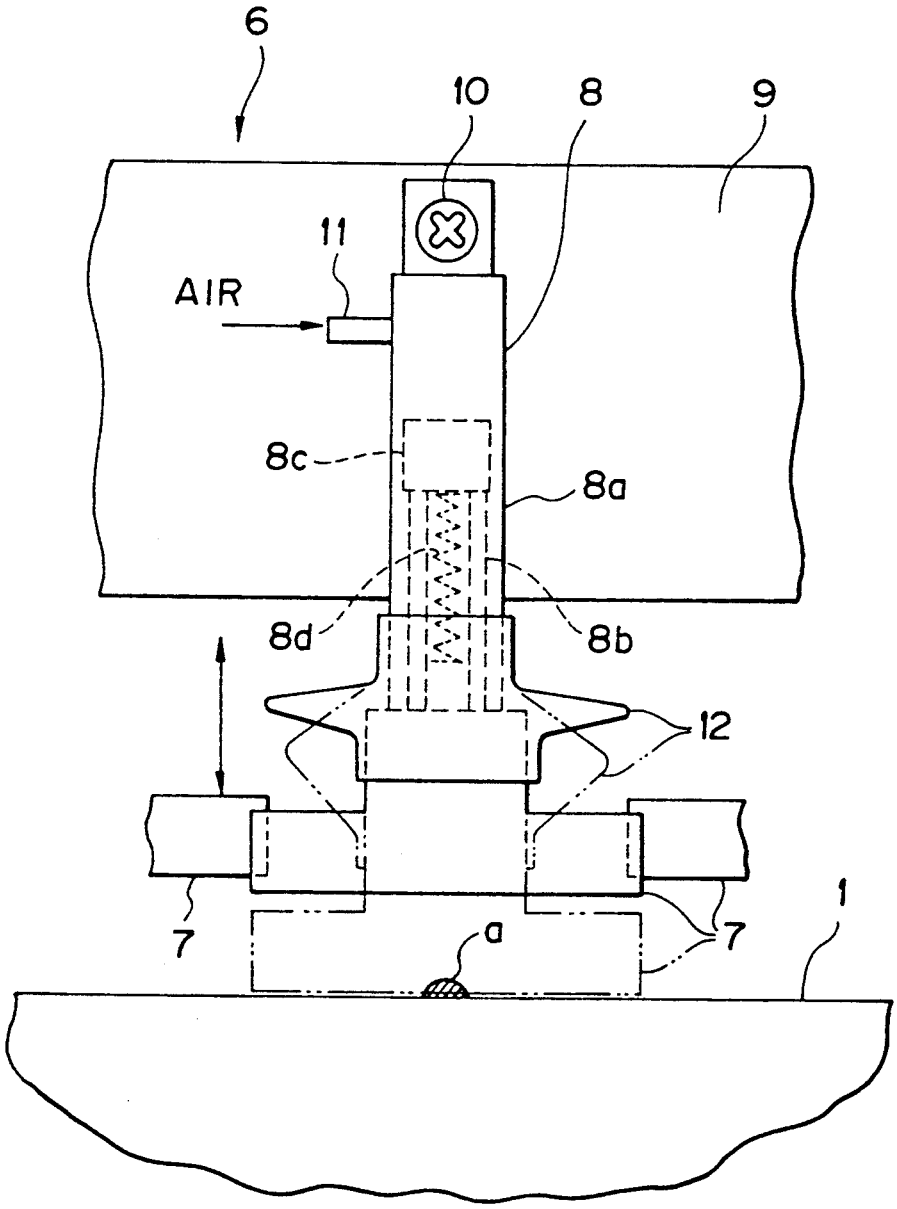
FIG. 2 is a plan view showing a part of the cleaner shown in FIG. 1.

Sometimes, dregs or stains a such as ink dregs, paper powders or the like would be stuck on a surface of the printing drum 1 as shown in FIG. 2. As shown in FIGS. 1, 2 and 4, a cleaner 6 for removing the dregs or stains a is arranged in the vicinity of the printing drum 1. The cleaner 6 is located between a position $C_0$ where the surface of the printing drum 1 contacts the surface of the blanket drum 2 and a position $C_1$ where the water applicator 5 is provided so that a small amount of ink on the surface of the printing drum 1 may be scraped.

As best shown in FIG. 1, each cleaner includes a plurality of scrapers 7 arranged along the surface of each drum 1*a*, 1*b*, 1*c* and 1*d* in each printing unit of the offset printing machine for scraping dregs on the printing drum surface, and air cylinders 8 for causing the scrapers 7 to contact or separate away from the surface of the drum.

The air cylinders 8 are mounted at a constant interval on a beam-like manifold 9 fixed in parallel with each printing drum 1*a*, 1*b*, 1*c* and 1*d* relative to a frame (not shown) of each printing drum. As best shown in FIG. 2, a cylinder body 8*a* of each cylinder 8 is fixed to the manifold 9 by a screws 10 and a distal end of each piston rod 8*b* faces the associated surface of the drum 1. An air introduction pipe 11 is provided at a rear portion of each cylinder body 8*a* for introducing air. A compressed coil spring 8*d* is interposed in a front portion of the cylinder body 8 for normally biasing a piston 8*c* rearwardly.

With such an arrangement, when the compressed air is not supplied thereto, the piston rod 8*b* is retracted in the opposite direction to the printing drum 1, whereas, when the compressed air is supplied thereto, the piston rod 8*b* is projected toward the printing drum 1.

The scraper 7 is made of hard rubber, hard resin or any other suitable material and is mounted in place with its head being directed laterally. A rubber bellow 12 is applied between a rear end of the scraper 7 and the cylinder body 8*a* in order to prevent the ink or the like from entering the cylinder body 8*a*. Preferably, a plurality (for example, 32–36) of scrapers are provided so as to correspond to respective ink adjustment screws of an ink fountain of the ink device 4. Also, preferably, the scrapers 7 are arranged in a staggered manner, as shown in FIG. 2, in order to keep no gap between the adjacent scrapers 7.

The respective scrapers 7 are brought into contact with and separated away from the surface of the printing drum 1 by the action of the air cylinders 8. As shown in FIG. 1, a plurality of first solenoid valves 13 are arranged for corresponding to a plurality of air cylinders 8. The first solenoid valves 13 are encased in a solenoid valve manifold for each printing unit.

A plurality of second solenoid valves 14 are provided for the respective manifolds, i.e., printing units and are disposed in respective pipes connected from a compressed air supply source (not shown) to the respective manifolds 15.

Figure 3:
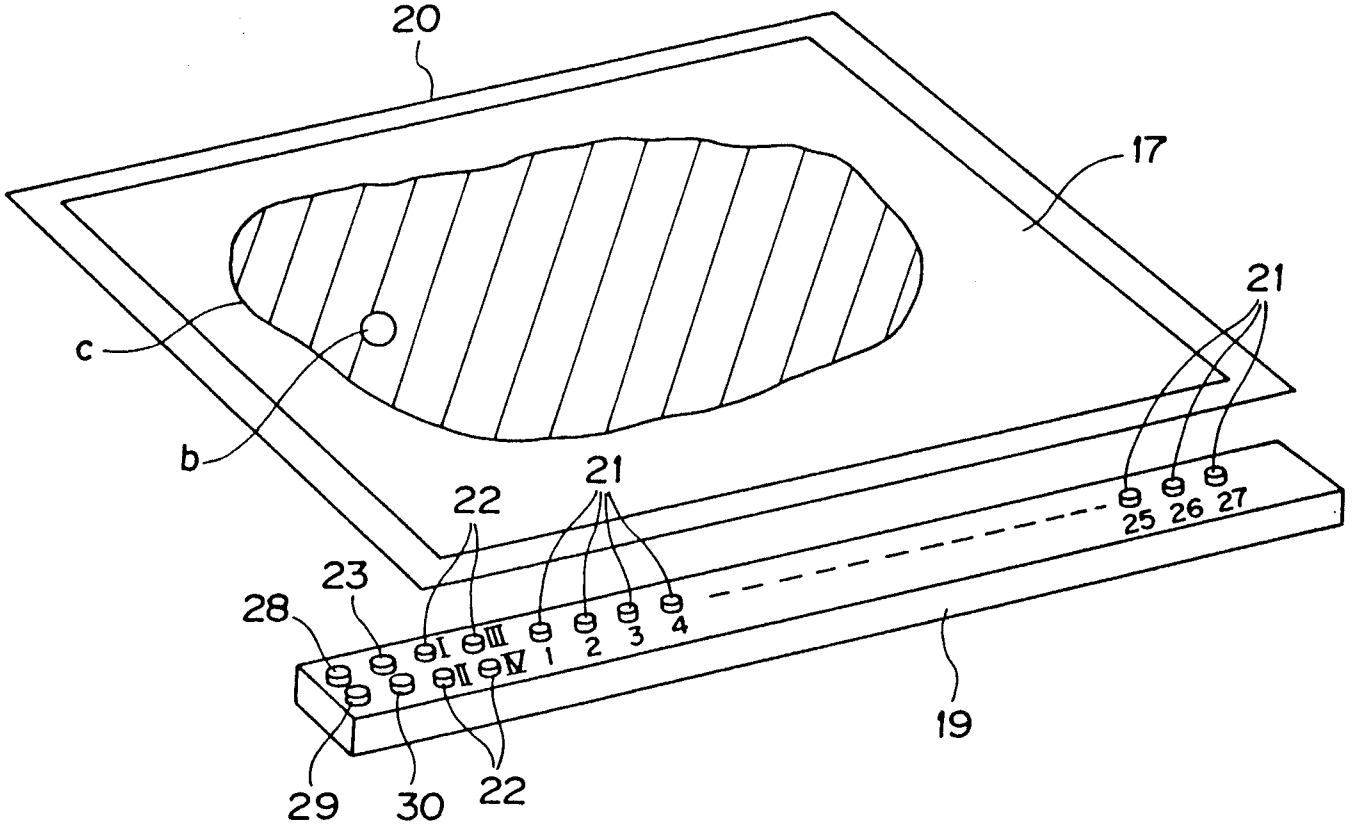
FIG. 3 is a perspective view showing the operational board and the color inspection base for the cleaner of the present invention.

The respective first and second solenoid valves 13 and 14 are controlled by a control unit 6 shown in FIGS. 1 and 3. The control unit 16 designates the position of dregs on the surface of the printing drums 1 in accordance with the position b of dregs on a printed matter (article) 17 on which the dregs b are generated corresponding to the dregs a on the surface of the printing drums. The control unit 16 operates the associated solenoid valves 13 and 14 to cause the scraper 7 to come into contact with the dreg position on the surface of the printing drums 1. The control unit 16 has a control board 18 and an operational board 19.

The operational board 19 is arranged along a predetermined edge of a color inspection base 20. The color inspection base 20 is a table to be used for placing thereon the printed matter 17 horizontally and is usually located in the vicinity of a delivery portion of the printing machine. The operational board 19 is arranged perpendicularly to the travel direction in the printing machine. In this case, the dregs called hickey are generated in the printed pattern c of the printed matter 17 on the color inspection base 20. The printed matter is drawn from the delivery section of the printing machine by the operator.

Incidentally, the operational board 19 may be mounted in the delivery section of the printing machine.

On the operational board 19, a number of hickey position designating buttons 21 are provided in one row along the edge of the printed matter 17. The hickey position designating buttons 21 are preferably arranged corresponding to the ink adjustment screws of an ink fountain (not shown) provided in the ink device 4.

At one end portion of the operational board 19, a plurality of unit designating buttons 22 are provided corresponding to the respective printing units of the printing machine. As shown in FIG. 1, in the case where the printing machine is of the four color type, four printing units are provided. Thus, the unit designating buttons 22 are provided corresponding to the associated printing units.

A cleaning button 23 is provided on the operational board 19 for actuating the air cylinder 8 to push the scraper 7 on the surface of the printing drum in the case where ink cleaning is effected to the printing machine. The cleaning button 23 may be provided in the delivery section of the printing machine.

Further, a power source button 28, a memory switch 29 and a start switch 30 are provided on the operational board 19. The power switch 28 is for turning on and off the control unit 16, the memory switch 29 is for driving a memory circuit to be described later, and the start switch 30 is for various circuits of the control board 18.

The control board 18 receives signals generated by the operation of the various buttons 21, 22, 23, 28 and 29 on the operational board 19 and controls the various solenoid valves 14 and 13. The control board 18 includes a solenoid valve drive circuit 24, a memory circuit 25, a timer circuit 26 and a digital switch 27.

The solenoid drive circuit 24 turns on and off the second solenoid valves 14 corresponding to a printing unit in which a hickey is generated and the first solenoid valve 13 corresponding to the position of hickey on the drum 1 of the printing unit.

The memory circuit 25 stores the hickey generating position which is to be designated by the unit designating button 22 and the hickey designating button 21.

The timer circuit 26 sets a period of time for opening each of the first and second solenoid valves 13 and 14. The digital switch 27 changes the set period of the timer circuit 26.

The solenoid drive circuit 24 opens all the second solenoid valves 14 by the "ON Operation" of the cleaning button 23 and subsequently opens and closes, in order, the first solenoid valves 13 from one end to the other end in every set time of the timer circuit 26. The reason why the first solenoid valves 13 are opened and closed in order is that an excessively large force is not applied at once to the manifold 9 due to the fact that all the scrapers 7 are brought into contact with the surface of the printing drum. If the excessively large force could be avoided, it would be possible to operate all the solenoid valves 13 and 14 by the "ON Operation" of the cleaning button 23.

Incidentally, it should be noted that the "ON Operation" of the cleaning button 23 is effected during the ink cleaning operation after the printing operation, and when the cleaning oil is supplied to the surface of the drum 1.

The cleaning operation of the cleaning device will be described in detail.

The power switch 28 is turned on by the operator of the printing machine for printing operation.

Then, as shown in FIG. 3, the printed matter 17 is laid on the color inspection base 20, and if the hickey b is found out, the position of hickey is designated by the button operation of the operation board 19.

For instance, if the hickey is generated on the printing drum 1*a* of the printing unit of a certain color in the printing machine, corresponding to a button 21 of number 4, first, the printing unit designating button 22 of the color is depressed, and subsequently, the button 21 of number 4 of hickey designating button 21 is depressed. Further, the memory switch 29 is depressed.

If hickey is found out with respect to the other color, the printing unit designating button 22 corresponding to the color is depressed in the same way, the corresponding hickey position designating button 21 is depressed, and then the memory switch 29 is depressed.

If there is no further hickey, the start switch 30 is depressed. Thus, the control board 18 turns on (or opens) the first and second solenoid valves 13 and 14 corresponding to the hickey. The air cylinder 8 causes the scraper 7 to scrape the surface of the printing drum by supply of the compressed air. The scraper 7 is brought into contact with the surface of the printing drum 1 in the period of time set by the timer circuit 26 to thereby remove and scrape the hickey such as ink dregs or paper powders. When the timer circuit 26 has been operated after a predetermined lapse of time, the second solenoid valve 14 is closed, and the air is removed from the air cylinder 8 so that the cleaning scraper 7 is separated away from the surface of the printing drum 1.

In the case where a plurality of hickeys a and b are generated, the air cylinders 8 are operated corresponding to the contents of the memory circuit 25 to thereby remove the hickeys in such a manner that a plurality of the corresponding air cylinders 8 are operated at the same time or the corresponding cylinders 8 are operated one by one.

The hickey position designating button 21, the printing unit designating button 22 and the cleaning button 23 have lamps in their interiors for cyclically flashing the lamps during the predetermined operation.

When the hickey is removed, the ink dregs or the like is stuck to the scraper 7. This may be removed by operating the cleaning button 23. Namely, the unit designating button 22 is depressed corresponding to the unit during the ink cleaning operation of the printing machine, and subsequently, the cleaning button 23 is turned on. Thus, the second solenoid valve 14 of the printing unit to be cleaned is operated to open, and the first solenoid valve 13 of the printing unit is operated in order from one end to the other end in accordance with the content of the memory of the memory circuit 25. The period of time when the first solenoid valve 13 is opened is controlled by the timer circuit 26.

In such a printing unit, the air cylinders 8 arranged in one row are operated in order from the one end to the other end during the cleaning operation, to thereby cause the scrapers 7 to scrape the surfaces of the printing drum 1*a*, 1*b*, 1*c* and 1*d*. If the removal operation is effected in the timer set period, the solenoid valves 13 and 14 are closed to interrupt the supply of air to the air cylinders 8.

According to the invention, with such an arrangement, it is possible for the operator to perform in an automatic manner the hickey removal operation without accessing to the place of the printing drums which rotated at a high speed. Thus, the safety is enhanced.

Since the number of cleaning scrapers and air cylinders are arranged relative to the surfaces of the printing drums in the axial directions, it is possible to remove quickly the stains or dregs of the printing surfaces. Accordingly, the loss of paper may be avoided. Furthermore, since the scrapers may be applied only to the position of hickey, it is possible to suppress the change of the ink supply amount to a minimum possible level.

What is claimed is:

1. A cleaning device for an offset printing machine, comprising:

a plurality of scrapers arranged along a surface of a printing drum of the printing machine for scraping hickeys on the surface of the printing drum;

a plurality of associated air cylinders for bringing the respective scrapers into contact with and away from the surface of the printing drum;

a plurality of solenoid valves disposed for the associated air cylinders; and a control unit having an operation board and a control board, said control board receiving signals generated by the operational board, the control board including a solenoid valve drive circuit, a memory circuit, and a timer circuit, said solenoid drive circuit turning on and off the valves, said memory circuit storing received signals indicating the positions of hickeys on the printing drum, said timer circuit setting a period of time for opening the valves to cause said scrapers to remove said hickeys.

2. A cleaning device according to claim 1, wherein said solenoid valves include a plurality of first valves for said scrapers, and a plurality of second valves for respective printing units.

3. A cleaning device according to claim 1, wherein said operational board includes means generating and inputting signals indicating the positions from which hickeys are to be removed.

4. A cleaning device according to claim 1, wherein the number of said air cylinders corresponds to the number of ink adjustment screws of an ink fountain.

5. A cleaning device according to claim 1, wherein said operational board is disposed along a color inspection table for placing thereon a printed matter and has a plurality of hickey position designating buttons which are disposed in a row along the printed matter.

6. A cleaning device according to claim 5, wherein said operational board further includes a plurality of unit designating buttons for designating a unit on which the hickeys are located, a cleaning button for ink cleaning operation and a memory switch for driving the memory circuit.

7. A cleaning device according to claim 1, further comprising a rubber bellows disposed between a rear end of the scrapers and the cylinders in order to prevent ink or the like from entering the cylinders.

8. A cleaning device according to claim 1, further comprising a piston associated with each air cylinder and a compressed coil spring being interposed in a front portion of the cylinders for normally biasing the piston rearwardly.

9. A cleaning device according to claim 1, wherein said scraper has a head and is made of hard rubber, hard resin or the like and mounted with its head directed laterally.

10. A cleaning device according to claim 1, wherein the timer circuit comprises a digital switch for changing the set period of time.

11. A cleaning device according to claim 2, wherein said solenoid valve drive circuit open and then close all of the second solenoid valves during an ink cleaning operation, and subsequently open and then close the first solenoid valves in every set period of time of the timer circuit.

12. A cleaning device according to claim 1, wherein said solenoid valve drive circuit includes means to open all the solenoid valves during an ink cleaning operation.

* * * * *